US006170310B1

(12) United States Patent
Wang

(10) Patent No.: US 6,170,310 B1
(45) Date of Patent: Jan. 9, 2001

(54) TRANSMISSION SHAFT OF A MOVABLE ARM OF A PIPE BENDER

(76) Inventor: Sheng-Tsung Wang, No. 1, Lane 764, Ta Wan Road, Yung Kang, Tainan Hsien (TW)

( * ) Notice: Under 35 U.S.C. 154(b), the term of this patent shall be extended for 0 days.

(21) Appl. No.: 09/407,094

(22) Filed: Sep. 28, 1999

(51) Int. Cl.[7] ..... B21D 7/04; B21D 9/05
(52) U.S. Cl. ..... 72/149; 72/155
(58) Field of Search ..... 72/149, 155, 156, 72/157, 158, 449

(56) References Cited

U.S. PATENT DOCUMENTS 1,985,454 * 12/1934 McCabe ..... 72/117
4,103,565 * 8/1978 Matikainen et al. ..... 74/665 L
4,843,858 * 7/1989 Grimm et al. ..... 72/149
5,462,098 * 10/1995 Murakami ..... 140/119
5,862,697 * 1/1999 Webster ..... 72/149

* cited by examiner

*Primary Examiner*—Rodney A. Butler
(74) *Attorney, Agent, or Firm*—Rosenberg, Klein & Lee

(57) ABSTRACT

A transmission shaft of a movable arm of a pipe bender comprises a main shaft, a sun gear ring and a central gear shaft. The main shaft has an upper end fixedly connected to the movable arm, and has several planet gears received therein; the planet gears each communicates with a corresponding one of side openings of the main shaft. The sun gear ring is located around, and engages the planet gears, and is fixed to a fixed arm of the pipe bender. The central gear shaft has an upper end gear portion passed into the main shaft, and engaging the planet gears. A lower end of the central gear shaft is connected to a power source. Thus, the main shaft can turn to move the movable arm when the central gear shaft is turned because the sun gear ring is fixed. The dimensions of the gears do not have to be increased to increase the torque because of the present structure.

3 Claims, 6 Drawing Sheets

TRANSMISSION SHAFT OF A MOVABLE ARM OF A PIPE BENDER

BACKGROUND OF THE INVENTION

The present invention relates to a pipe bender, which has a shaft, a movable arm and a fixed arm. The movable arm is movable with the shaft in order to bend a pipe positioned between the movable arm and the fixed arm.

Referring to FIG. 6, a heretofore known pipe bender comprises a covering 11, a shaft holder 12, a shaft 13, a movable arm 14, a fixed arm 15 and a transmission combination 16.

The transmission 16 is arranged in the covering 11, and has an oil cylinder 161. The oil cylinder 161 has one end connected to a chain 162, and the other end connected to a chain 163. The chains 162,163 wind around a first wheel 164 and a second wheel 165 respectively, and then connect a connecting rod 166.

Referring to FIG. 7, the oil cylinder 161 makes the shaft 13 turn in order to move the movable arm 14 relative to the fixed arm 15. Thus, the movable arms 14 and the fixed arm 15 can bend a pipe located in between.

The process and fastening means for locating a pipe to the fixed arm and the movable arm are not a subject of the present invention, so they are not detailed here.

From the above description, it can be seen that the pipe is bent by means of the cylinder driving the first wheel 164. Therefore, the wheel is made to have a circumference as big as possible in order for the pipe bender to have more power. However, the size and the cost of the pipe bender will increase when the wheel is big, i.e. the pipe bender is less cost-effective.

SUMMARY OF THE INVENTION

It is a main object of the present invention to provide a transmission shaft for a pipe bender, of which the dimensions do not have to be increased to increase the torque output.

The transmission shaft of a movable arm of a pipe bender comprises:

a main shaft having an upper end fixedly connected to the movable arm; the main shaft further has:

(i) several evenly spaced pin holes each receiving a pin therein;

(ii)openings each communicating with a corresponding one of the pin holes;

(iiii) planet gears received in the main shaft, each being pivoted on a corresponding one of the pins and communicating with outside through the openings;

a sun gear ring fixed to a connecting part of a fixed arm of the pipe bender, the sun gear ring being located around, and engaging the planet gears; and, a central gear shaft having an upper end portion passed into the main shaft, and engaging the planet gears for passing on power to the planet gears.

Whereby, the main shaft can turn to move the movable arm when the central gear shaft is turned because the sun gear ring engaging the planet gears is fixed.

BRIEF DESCRIPTION OF THE DRAWINGS

The present invention will be better understood by reference to the accompanying drawings, wherein.

DETAILED DESCRIPTION OF THE PREFERRED EMBODIMENTS

Figure 1:
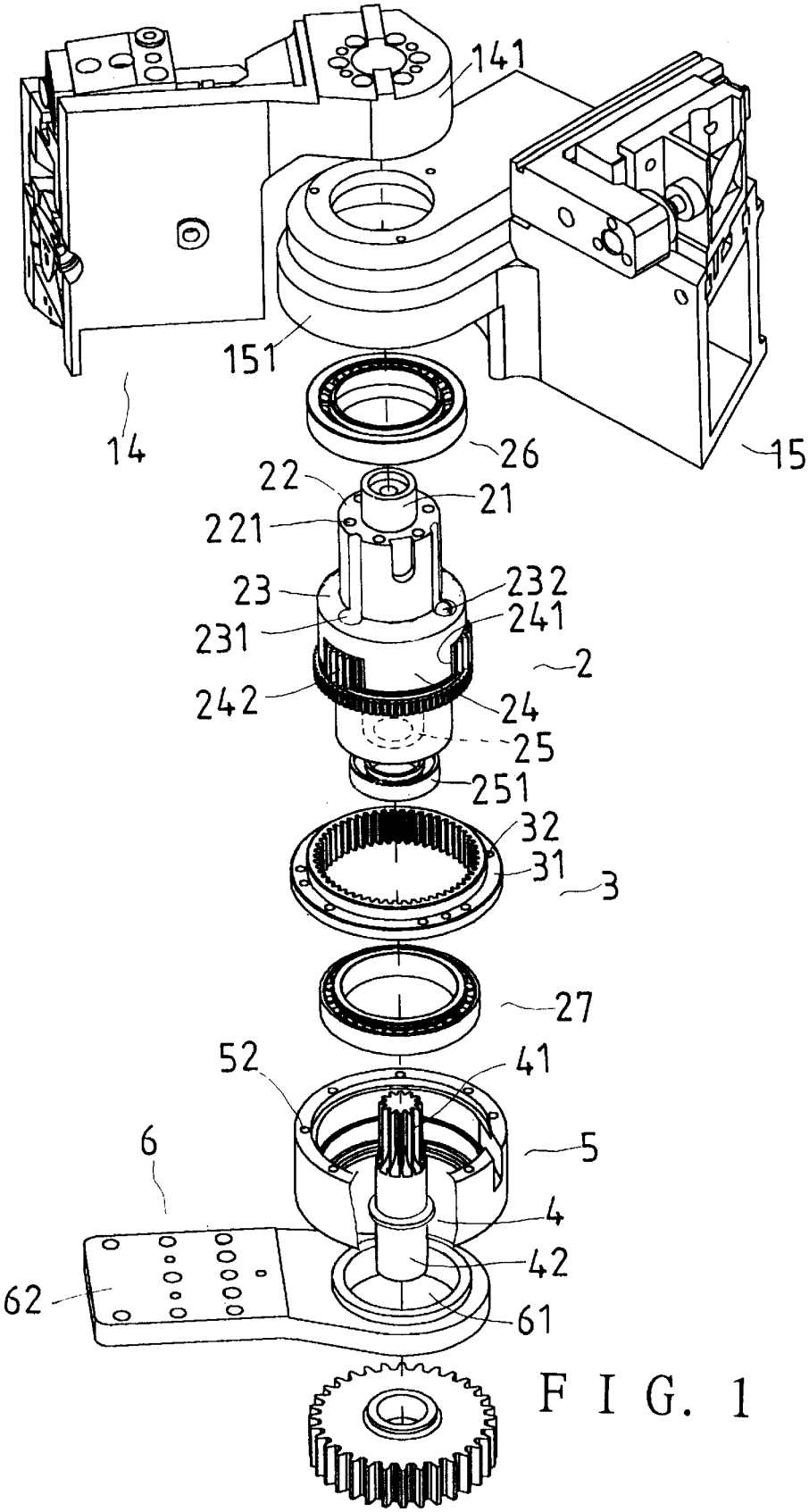
FIG. 1 is an exploded perspective view of a transmission shaft of a movable arm of a pipe bender of the present invention.

Referring to FIG. 1, a transmission shaft of a pipe bender of the present invention comprises a main shaft 2, a sun gear ring 3, a central gear shaft 4 and a connecting element 5. A fixed arm 15 of the pipe bender has a connecting part 151.

Figure 2:
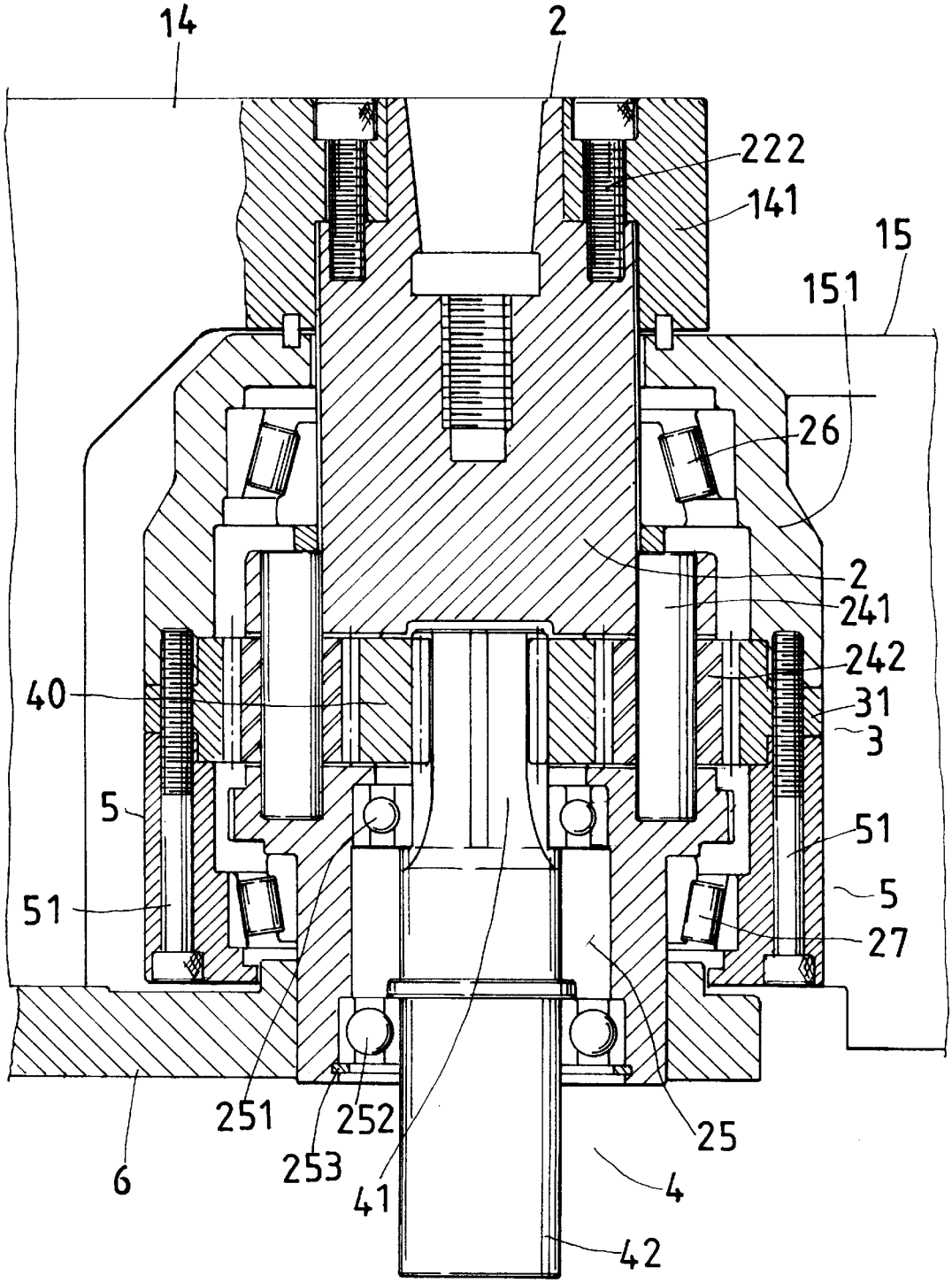
FIG. 2 is a cross-sectional view of the transmission shaft of a movable arm of a pipe bender of the present invention.

Referring to FIG. 2, the main shaft 2 has a projection 21 on an upper end 22 thereof. The upper end 22 has several screw holes 221. Bolts 222 are screwed into a connecting portion 141 of the movable arm and the screw holes 221 in order to connect the main shaft 2 to the movable arm 14.

The main shaft 2 has several evenly spaced pinholes 231 each having a pin 232 received therein. The number of the pinholes 231 is no less than three. The pinholes 231 each has a corresponding opening 241 on the main shaft 2. The openings 241 each communicates with a planet gear 242 received in the main shaft; the planet gears 242 are each pivoted to a corresponding one of the pins 232.

The main shaft 2 further has a central hole 25 receiving bearings 251, 252 and a fastening ring 253.

Figure 3:
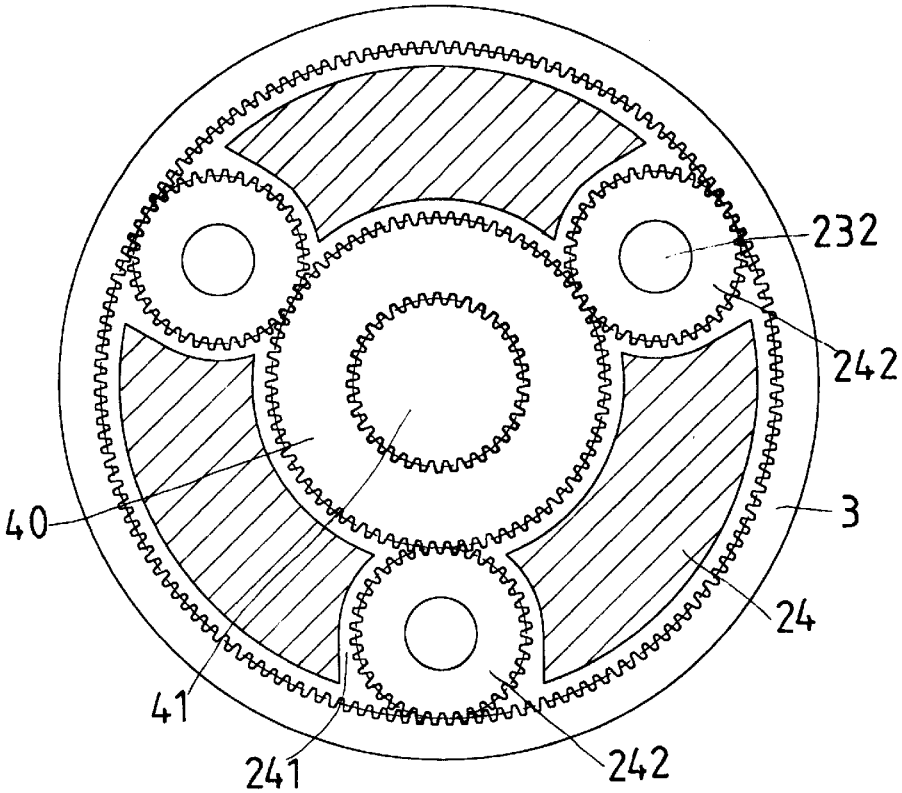
FIG. 3 is a cross-sectional view of the main shaft of the present invention.

Referring to FIG. 3, the central gear shaft 4 is passed into the central hole 25 of the main shaft 2 with a gear portion 41 thereof engaging a gear ring 40. Thus, the central gear shaft 4 can pass on power to the planet gears 242. The central gear shaft 4 further has a connecting portion 42 projecting out from the main shaft 2 for connecting a power.

Figure 4:
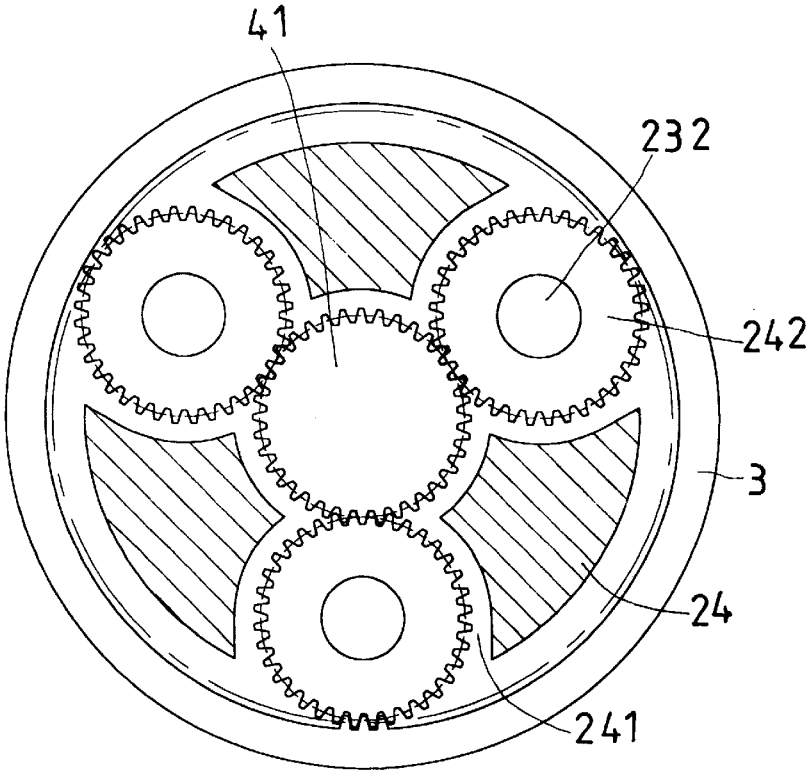
FIG. 4 is a cross-sectional view of the main shaft according to the second embodiment of the present invention.

In a second embodiment of the present invention, referring to FIG. 4, the plant gears 242 engage the gear portion 41 of the central gear shaft 4 directly.

The upper end portion of the main shaft 2 is connected to the connecting part 151 by means of an upper bearing 26. The connecting part 151 has the sun gear ring 3 and the connecting element 5 received therein. A lower bearing 27 is located in the connecting element 5. Bolts 51 are screwed into holes 52 of the connecting elements 5, holes 32 on a rim 31 of the sun gear ring 3, and a lower side of the connecting part 151 of the fixed arm 15 to fix the connecting part 151, and the sun gear ring 3 to the fixed arm 15.

A plate 6 is provided on a lower end portion of the central gear shaft 4. The plate 6 has a hole 61 connected to the lower end portion of the main shaft 2, and has a front part 62 connected to the movable arm 14. Thus, the movable arm 14 is connected to the main shaft 2 from two ends thereof for permitting it to move relative to the fixed arm 15 to bend a pipe.

Figure 5:
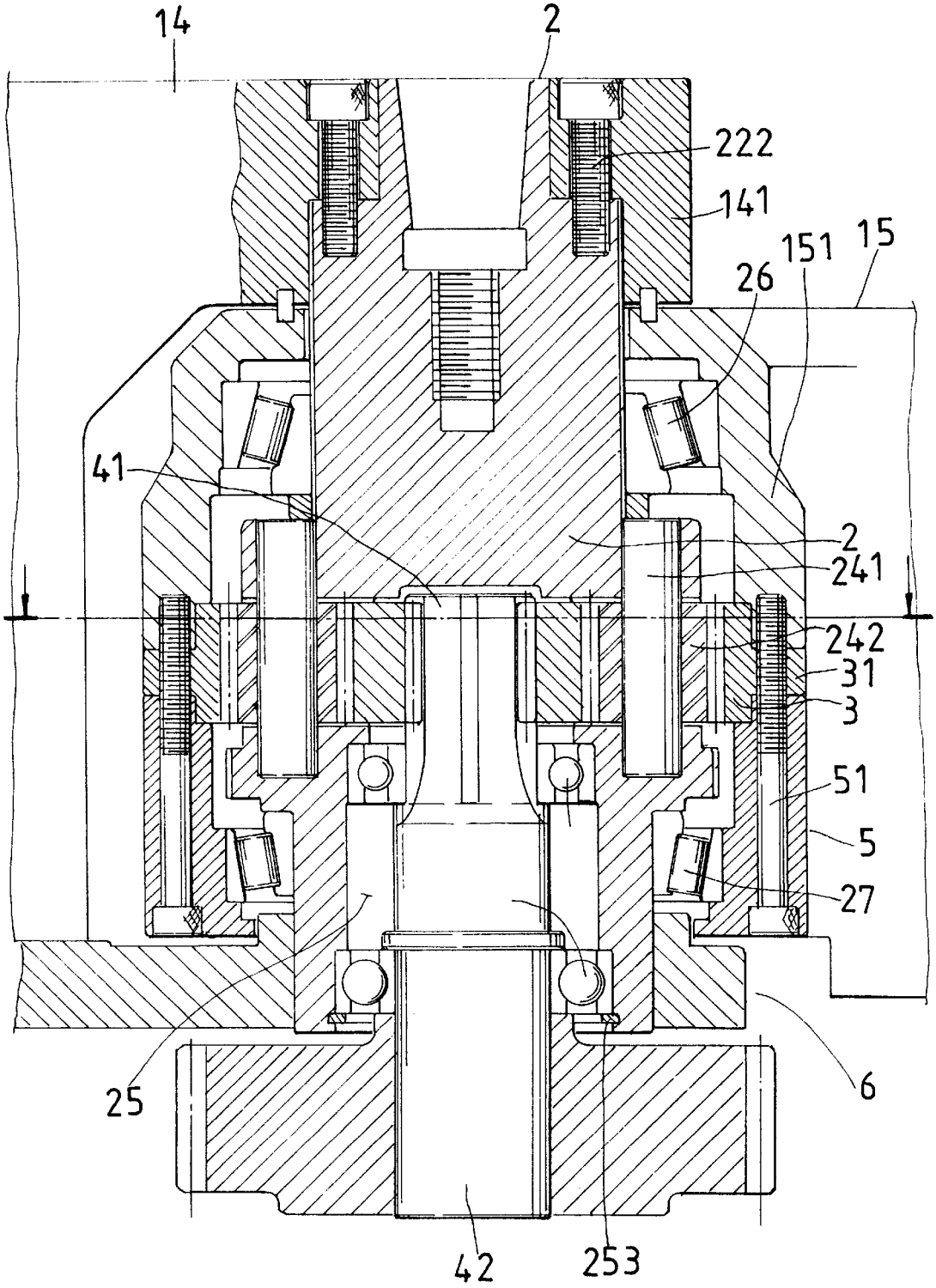
FIG. 5 is a cross-sectional view of a transmission shaft according to the second embodiment of the present invention.
Figure 6:
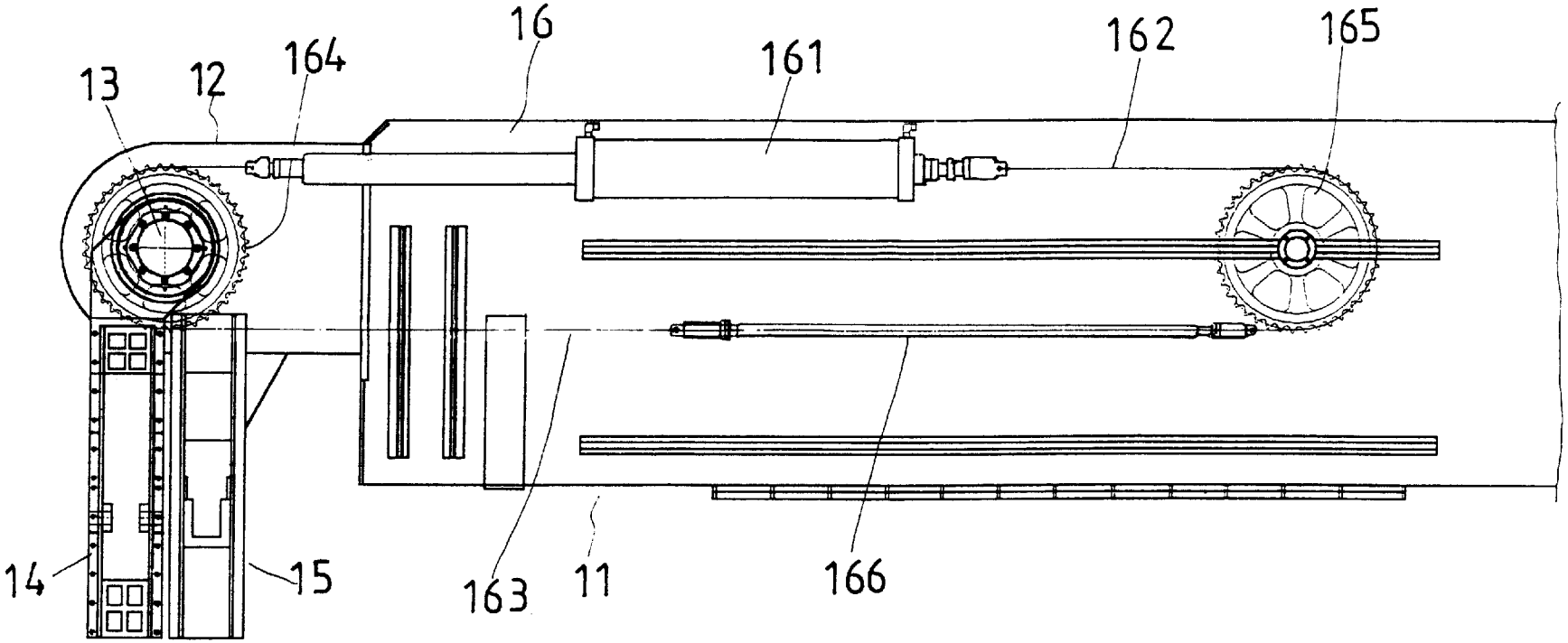
FIG. 6 (PRIOR ART)
FIG. 6 is a view of the structure of the prior art pipe bender as described in the Background.
Figure 7:
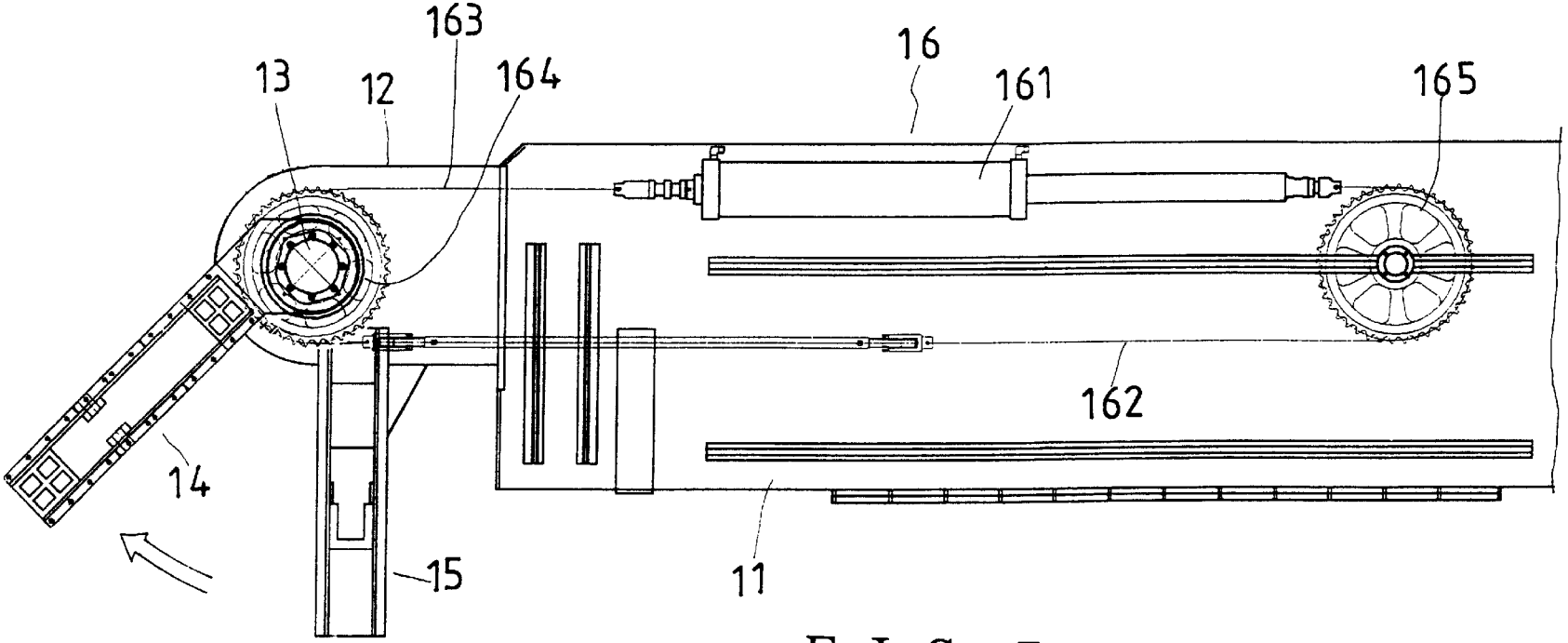
FIG. 7 (PRIOR ART)
FIG. 7 is a view showing the movement of the prior art pipe bender in FIG. 6.

Referring to FIG. 5, the connecting portion 42 of the central gear shaft 4 can be provided with a gear; the gear can then engage gears of the power source. When the central gear shaft 4 turns, the planet gears 242 engaging the upper end gear portion 41 will also turn. Because the planet gears

242 engage the fixed sun gear ring 3, the planet gears 242 will turn and move around the sun gear ring 3. Thus, the main shaft 2 will also turn because the planet gears 242 are connected to the pins 232 fixed to the main shaft 2; consequently the movable arm 14 can be moved.

From the above description, it can be understood that the transmission shaft of a pipe bender of the present invention has desirable features as follows.

1. The dimensions of the transmission shaft can be decreased without decreasing the power output.

2. The central gear shaft 4 can be directly connected to the power source for increasing the torque.

What is claimed is:

1. A transmission shaft of a movable arm of a pipe bended, comprising:

(a) a longitudinally extended main shaft having an upper end fixedly connected to said movable arm of said pipe bender, said main shaft having:

(i) a longitudinally directed cavity formed therein;

(ii) a plurality of evenly spaced longitudinally directed pinholes each receiving a pin therein, said plurality of pin holes being in open communication with said cavity;

(iii) a plurality of openings formed through a wall of said main shaft and in open communication with said cavity, each of said openings being located in correspondence with a respective one of said pinholes;

(iv) a plurality of planet gears received in said cavity of said main shaft, each being pivoted on a corresponding one of said pins, and a portion thereof extending through a corresponding one of said openings; and, (v) a gear ring disposed in said cavity of said main shaft and having a through hole formed centrally therein, said gear ring having teeth formed on an external surface thereof engaged with said plurality of planet gears for rotation of said planet gears responsive to rotation of said gear ring, said through hole having an internal surface with teeth formed thereon;

(b) a sun gear ring fixed to a connecting part of a fixed arm of said pipe bender, said sun gear ring being located around, and engaging said portion of said planet gears extending through said openings; and, (c) a central gear shaft having an upper end gear portion passed into said cavity of said main shaft, said upper end gear portion being received in said through hole of said gear ring and engaging said teeth on said internal surface for passing on power to said planet gears through said gear ring, whereby the movable arm is rotated by rotation of the main shaft, the main shaft being rotated by displacement of the planet gears relative to the sun gear ring when the central gear shaft is turned because the sun gear ring engaging the planet gears is fixed to the fixed arm and the upper end gear portion of the central gear shaft engages the gear ring to rotate therewith to rotate the planet gears.

2. The transmission shaft of a movable arm of a pipe bender as claimed in claim 1, further comprising:

a. a connecting element coupled to said connecting part of said fixed arm, b. an upper bearing mounted to said connecting part of said fixed arm, said main shaft upper end being passed into said upper bearing, and c. a lower bearing mounted in said connecting element, said main shaft having a lower portion passing through said connecting element and said lower bearing.

3. The transmission shaft of a movable arm of a pipe bender as claimed in claim 1, further comprising a plate having one end thereof connected to said movable arm, said plate being connected to said lower end portion of said main shaft.

* * * * *